United States Patent [19]

Bischoff

[11] Patent Number: 4,750,304

[45] Date of Patent: Jun. 14, 1988

[54] MOBILE CONTAINER SYSTEM

[76] Inventor: Rainer Bischoff, In den Gassen 26, 5407 Boppard 4, Fed. Rep. of Germany

[21] Appl. No.: 897,847

[22] Filed: Aug. 18, 1986

[30] Foreign Application Priority Data

Aug. 17, 1985 [DE] Fed. Rep. of Germany ..... 3529556

[51] Int. Cl.[4] ..... E04D 15/00

[52] U.S. Cl. ..... 52/126.3; 52/277; 52/584

[58] Field of Search ..... 52/584, 586, 587, 126.3, 52/277, DIG. 11, 143, 127.11, 127.7, 579, 580; 403/290, 381; 24/633, 634, 635, 664

[56] References Cited

U.S. PATENT DOCUMENTS

| | | | |
|---|---|---|---|
| 1,825,357 | 9/1931 | Lasselsberger | 24/635 |
| 3,233,935 | 2/1966 | Brindle | 52/143 X |
| 3,310,917 | 3/1967 | Simon | 52/586 X |
| 3,690,077 | 9/1972 | Dalgliesh, Jr. et al. | 52/584 X |
| 3,923,134 | 12/1975 | Rezazadeh | 52/584 X |
| 4,251,968 | 2/1981 | Raith et al. | 52/584 |
| 4,404,780 | 9/1983 | Josephson | 52/143 X |
| 4,544,300 | 10/1985 | Lew et al. | 403/381 X |

*Primary Examiner*—Carl D. Friedman

*Attorney, Agent, or Firm*—Michael J. Striker

[57] ABSTRACT

A mobile container system for providing rooms for human occupancy having flat plate wall elements, each having a polyurethane foam core coated with aluminum or glass fibers. The walls are arranged into cube-like structures, and the cubic structures may be joined together. Each wall edge has a joint fastened on it with a projection extending outward from the edge with an arrow shaft and arrow head shape cross-section. The arrow head shape is thicker than the shaft. Angles are provided to interlock the wall elements by the projections. The angles have sockets conforming in shape to the projections. The walls of the socket may be pushed apart by turning an oval-shaped member lying therebetween to allow the arrow head to pass between the walls and into an accommodating area of the socket.

26 Claims, 8 Drawing Sheets

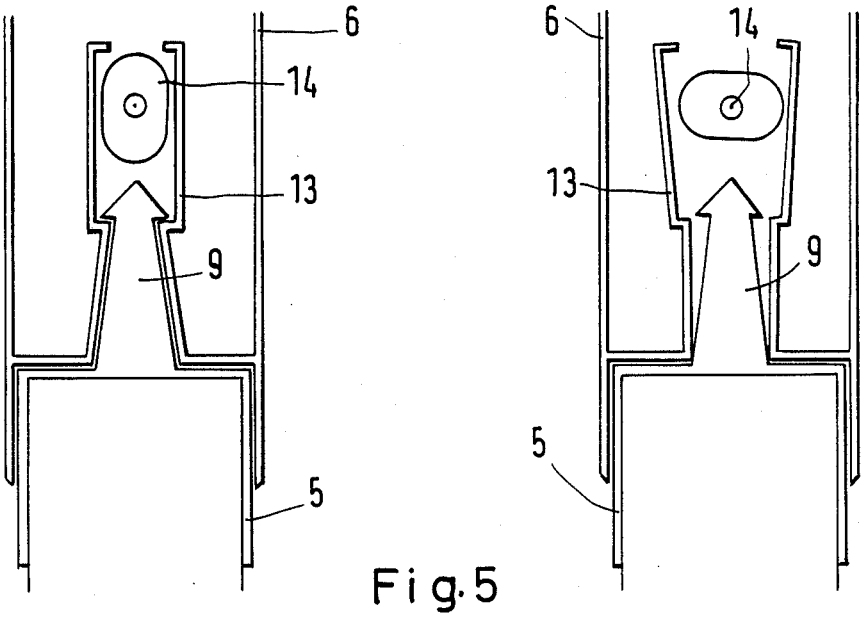
Fig. 5
Fig. 6
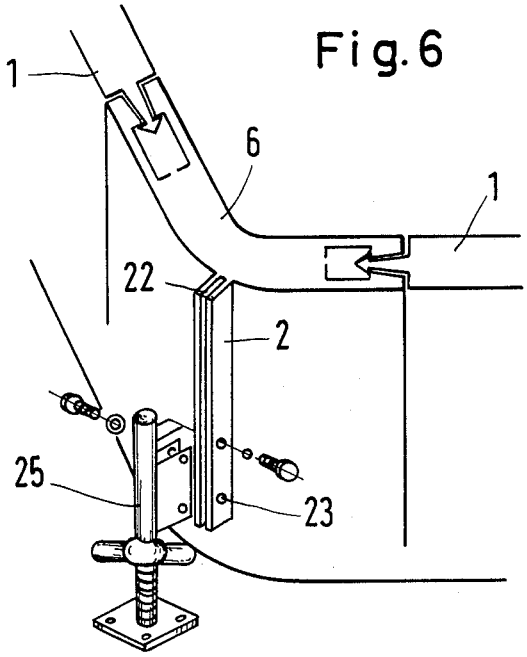

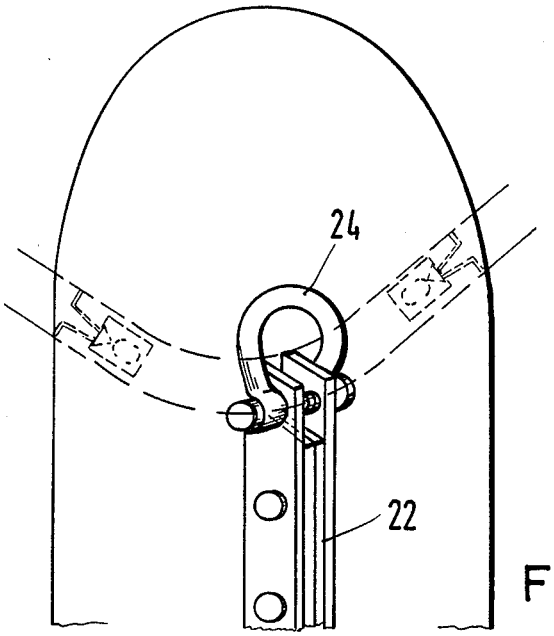
Fig. 7
Fig. 8
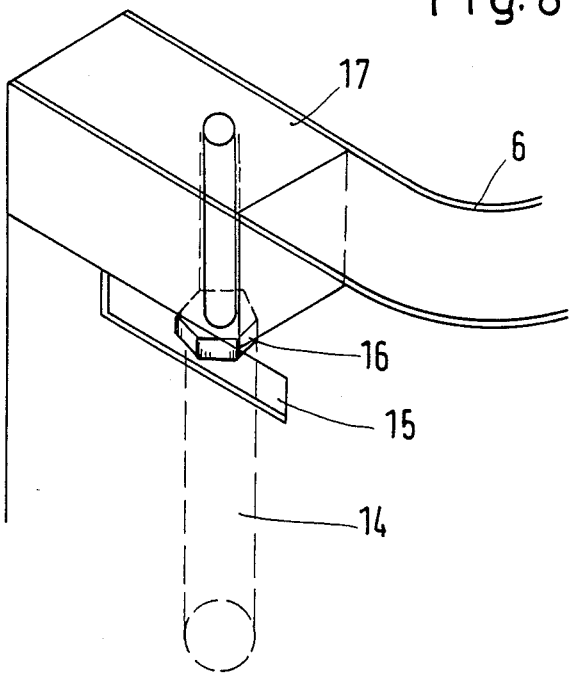

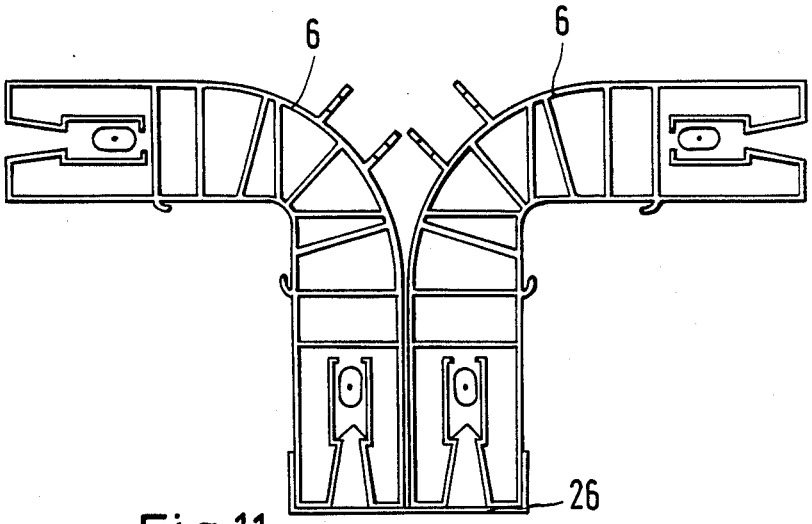
Fig.11
Fig.12
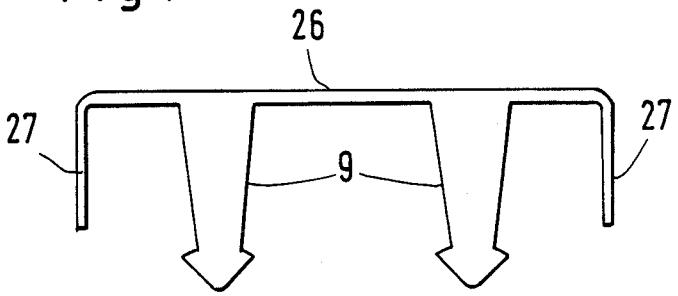

Fig. 13
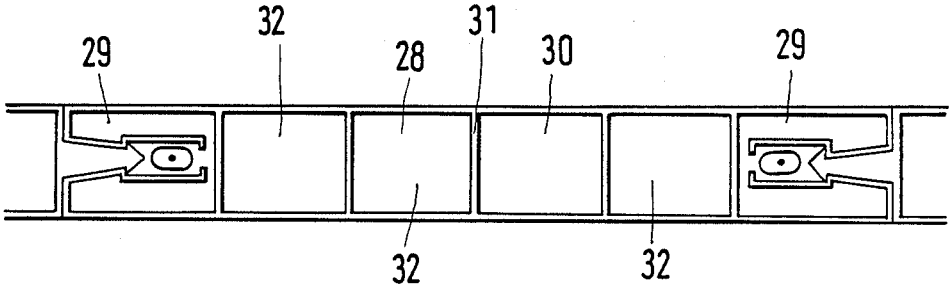
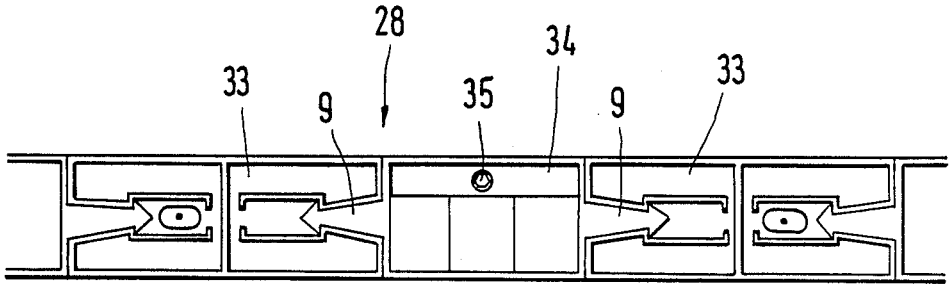
Fig. 14

MOBILE CONTAINER SYSTEM

FIELD OF THE INVENTION

The invention relates to a mobile container system to provide living and utility or working rooms consisting of plate-like wall elements and easily fitted joints.

BACKGROUND OF THE INVENTION

There are many circumstances in which rooms are required for short-term human occupation and work or the like. One example is the occurrence of a disaster. In addition to rooms for treating the sick and operating theatres, living and sleeping accommodation for rescue personnel are also required, as well rooms for kitchen and food supplies and other necessaries, such as office work and the like. It has hitherto been customary to employ mobile accommodation complexes, i.e. vehicle-mounted, or otherwise being suitable for transport, tent-like facilities. In disasters, it is often a matter of how fast a facility can be available for use. Vehicle-mounted facilities frequently cannot be used because the approach roads cannot be negotiated and airborne facilities need landing grounds, which are frequently unavailable, so that, in the final analysis, primitive initial facilities are employed which can be carried by helicopters. A further complication is that disaster rescue services must be suitable for any and every kind of climate, i.e. the rescue facilities must cope with arctic cold and snow storms as well as tropical sweltering heat and downpours of rain and desert heat. Finally, they must depend considerably on the nature of the sub-soil, because the presence of level, dry and firm terrain is the rare exception. It is evident that in such cases, tents and similar light-weight first-aid facilities do render valuable service but are scarcely adequate for meeting the conditions of climate or of terrain.

There are, it is true, lightly constructed facilities which can be dismantled and re-erected and are transportable in the form of a kit. However, their assembly and preparation as a rule take a lot of time and require the services of quite a large number of rescue personnel, often skilled manpower, so that the immediate availability of such facilities is out of the question.

Such readily assembled systems of accommodation are as a rule pre-planned and pre-fabricated, i.e. predetermined in their final form. This restricts, on the one hand, the nature of accommodation possibilities varying from disaster to disaster and in addition impedes construction at any and every location, because the predetermined form of the accomodation postulates suitable terrain.

The field of application of the container systems initially disclosed is not, however, restricted to disasters, but extends to a variety of other fields. According to season, for example, rooms are temporarily required for tourism in specific cases in substantial numbers. For large events, rooms are needed for accommodation and administration, and offices are needed for the management of congresses and conferences and the like, which are provided for short-term use and then have to be removed.

SUMMARY OF THE INVENTION

The task underlying the invention is to create for such purposes a mobile container system of the kind initially mentioned which is lightweight, can be assembled by two workers in the shortest possible time and which, building from one basic unit, can be combined into any desired accommodation structure.

To solve this problem, the mobile container system of the present invention is characterized by the fact that the wall units are formed as six square sandwich plates with a core consisting preferably of rigid polyurethane foam, covered on both sides with aluminum or glass fibre (GF), and provided with doors, windows and ventilation apertures as required. Joints are formed as extruded GF or aluminum, preferably multi-chamber sections, so that an edge section is fitted tightly with a mechanically strong and non-detachable U-shaped cross-sectional piece to all four edges of the sandwich plates. The joint has an arrow-shaped spigot pointing away from the edge in the plane of the plate with the arrow shaft tapering towards the arrow head. An angle section has two sockets running at right angles to one another which are bounded by web sections biassed towards the end and deflectable outwards, the configuration and shape of which match the arrow-shaped spigot and fit it exactly. A non-circular, preferably oval spreader spindle is pivoted at the upper and lower end of the angle section. This spindle is provided on at least one end with an actuating square or hexagonal head, which is accessible from the outside. The spindle extends between the ends of the two web sections bounding the socket and holds the web sections when the oval is turned transversely to the length of the socket. The web sections can be so far spread apart widthwise from one another that the triangular arrow head, which broadens at its base, can be inserted between the web sections. On the outside of the angle section, two supporting side-pieces running symmetrically to the center of the corner angle in the longitudinal direction of the section and are spaced apart. In combination, all the sandwich plates and joints form a cube, which can be dismantled again as required or transported as a whole using chair, ropes, etc. acting upon the supporting side-pieces. The lower ends of the supporting side-pieces may be connected with vertically adjustable uprights.

It is further advantageous that two or more cubes can be joined together in linear, star or angle units. The sandwich plates on the resulting adjacent sides of the cubes are at a distance apart and the open ends of the angle sections are closed and connected firmly together by a clamp section, which has a U-shaped cross-section and two spigots in shape and size like the arrow-shaped spigot on the edge sections. The clamp section engages the ends of the angle sections and projects inwards from the base of the angle section. Horizontal sandwich plates, which form the floor and if need be the roof, point towards one another with their edge sections are continuously linked tightly and firmly together by an adjustment section, whose edge cross-sections are like the shape of the ends of the angle sections for receiving the edge sections.

In accordance with claim 1, a mobile container system is disclosed which in a very short space of time can be assembled into a cube-shaped room. As the sandwich units forming the individual boundary surfaces of the room, already contain doors, windows etc., the room concerned can be used or occupied immediately after assembly. The sandwich plates, weighing less than 49 kg or at most 49 kg because of the light construction, can be handled comfortably by two persons. Due to the sandwich construction, the core of which is polyurethane rigid foam, and the outside covering layers are either aluminum 1.5 mm thick or corresponding plastic sheets, there is outstanding heat insulation capability, i.e. the heat transmission loss is less than 0.5 watts per sq. m. Kelvin. This means that the cube or the room is any given climatic zone is weather and heat resistant, and, especially, also heat-insulated. The sections mentioned serve the purposes of assembly. The triangular broadened head of the arrow shaped spigots locks behind the matching shape of the inner web sections, which are forced apart by the non-circular spindle on the angle or corner sections. This produces a form- and force-locking connection which, if necessary, can be made not only moisture-tight but also gas-tight by packing with elastic seal. In the event of chemical disasters or in such applications, structures or rooms created in this way, can, after being dismantled, be reliably decontaminated at leisure, because plastic and aluminum are resistant and can be treated with decontamination agents. Levelling the floor to the horizontal position requires only that appropriate uprights be made fast to the outside supporting legs, which can then be sufficiently adjusted by means of screw spindles, hydraulically or the like, so that a horizontal position of the floor is achieved. If a room thus made available is to be transported, a carrying or loading harness can be bolted to the upper ends of the supporting leg. The whole cube, particularly in view of its light weight, can be transported by a helicopter.

It is important that the sandwich plates have dimensions of 2440×2440 mm and can therefore be loaded into any standard container commonly used for transport purposes. The mobile container system designed in accordance with the present invention can, for example, be brought in the dismantled condition in a standard container to a nearby location, assembled there an then flown, by helicopter or the like, a short distance to the point of use.

Of particular significance, however, is the further embodiment or parallel invention, whereby the cube can be combined with other cubes in systems of any desired structure in any desired way, i.e. variously from one type of use to another. Those sandwich plates which, in the process of combination, abut laterally, are simply left out or removed. The ends of the corner sections which are then open are closed by clamp sections and firmly connected together. The floor and roof plates are linked by adjustment sections. This means that, with the help of this embodiment, the solution to the problem underlying the invention is complete, changes can be effected as desired in the rooms provided depending on function and location.

It is of particular significance, in accordance with a further embodiment that the angle sections between the ends, or end-pieces, be curved with a relatively small interior radius of curvature or alternatively run straight at an angle of 45° to the ends. In the straight or curved area there are several webs forming the boundaries of chambers, which contain supply and discharge pipes and/or tubes within foam.

The angle sections, in accordance with another embodiment, are curved in shape and are preferably used for the vertical edges of the cube, because on the inside they permit use of space right into the corners. The straight, diagonal shape can be more advantages for the roof seams. Of particular significance, is the fact that the chambers contain all the supply and discharge pipes and/or tubes within foam, so that the necessary supply and discharge units must simply be connected from the outside to the completed cubes in order to supply the interiors with electricity, water, gas, etc. By enclosing the appropriate pipes or tubes in foam in the chambers, frost damage is avoided.

It is particularly advantageous if, in accordance with yet another embodiment, the angles of the cube are closed off by angle covers, consisting of an outer and inner cover. The outer cover is adapted to the optionally curved or straight-line contours of the angle-sections by two corresponding design shapes and has a supporting clamp or thread bolt pointing inwards, and fits by means of elastic sealing outside on the angle section. The inside cover is adapted to the interiors of the angle section and a connecting panel is provided with a hole for the bolt from the outer cover and can be firmly connected with the outer cover by means of a bolt lever, nut or the like. Thus the connecting panel is equipped with non-interchangeable sockets and connector devices which are linked with the supply and discharge pipes or tubes in the chambers of the angle sections.

Due to the non-interchangeability of the connector devices, sockets and the like, perhaps also to the possibility of fitting monitoring devices, measuring devices and switchgear, each cube has its own supply available for the moment it is assembled to meet any arising needs.

The adjustment section in accordance with another embodiment, in order to avoid a gap, provides an intermediate area reinforced with web sections and which is therefore subdivided into chambers. The chambers can be lined with foam to avoid damage from heat or cold.

An alternative embodiment consists of making the adjustment section from at least three part-sections, whereby the two edge cross-sections are independent and each has two socket ends opening in opposite directions to take an arrow-shaped spigot. A third middle-piece has two lateral arrow-shaped spigots facing in opposite directions and a center-piece, which is hollow and arranged to receive or attach vertically adjustable uprights.

Such an alternative embodiment is especially suitable for the floor, because it provides the possibility of arranging additional supports at any desired place in order to absorb the floor load uniformly, especially if heavy equipment or facilities are installed in the cube. The form of embodiment mentioned is particularly suitable for roof plates.

Adjustment sections in the roof and floor areas replace the angle or corner sections and thus avoid the possibility that ends of corner sections, projecting upward from below, stick out as steps or obstacles into the floor area.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 5—two sectional views of an edge and an angle section, in which the left-hand drawing represents the assembled and the right-hand one the section in the assembled position before the form- and force-locking connection is made FIGS. 6 and 7—examples of how uprights or lifting harness are fastened to the supporting side-pieces of the corner sections.

FIG 8—a partial view illustrating operation of the spreader spindle on the corner section.

FIG. 11—two corner sections linked by a clamp section to form combined room systems.

FIG. 12—a sectional view of the clamp section used in FIG. 11,

FIG. 13—a possible development of the adjustment section.

FIG. 14—an alternative development of the adjustment section in a multi-part refinement.

DETAILED DESCRIPTION OF THE PREFERRED EMBODIMENTS

Figure 1:
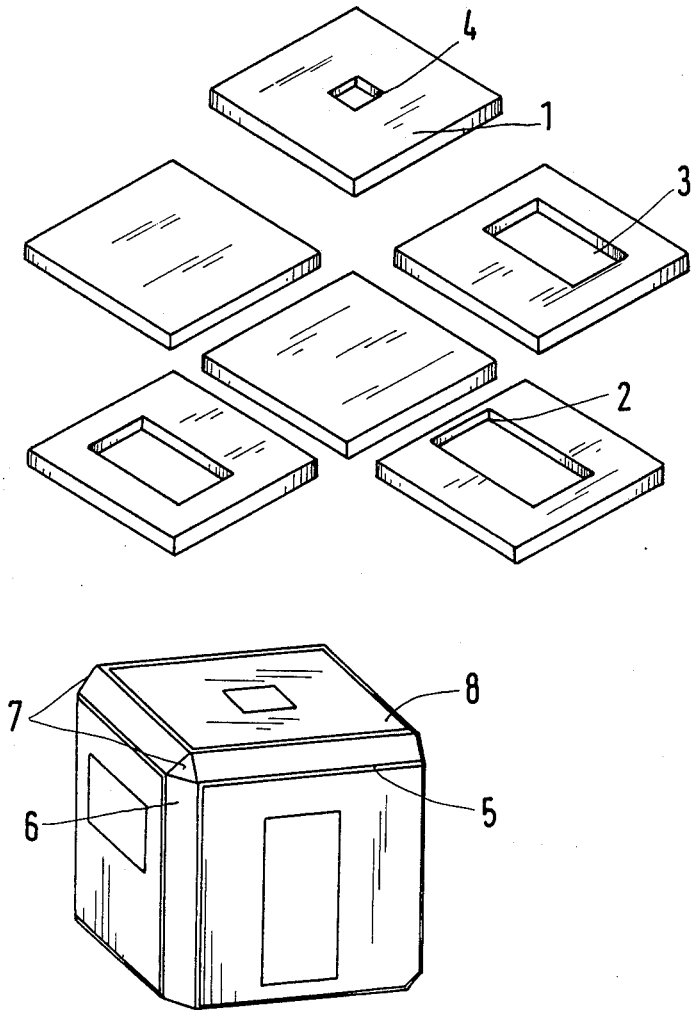
FIG. 1—the cube assembled from the mobile container system and its sandwich plates in the dismantled condition FIG. 2—a ground plan of a container or room system, more especially a medical care unit assembled from the cub represented in FIG. 1.

The drawings show the details of a mobile container system to provide living, utility and working rooms. The basic units as shown in FIG. 1 are square sandwich plates 1, having a rigid polyurethane foam core and outside covering of glass fibre plastic or aluminum 1.5 mm thick and which, according to use, either have doors 2, windows 3, or roof openings 4 already fitted with ventilators (not shown) if required. These sandwich plates 1, six in number, can be assembled with the aid of edge sections 5, corner sections 6 and corner covers 7 into a cube 8, which is shown below in FIG. 1.

Figure 2:
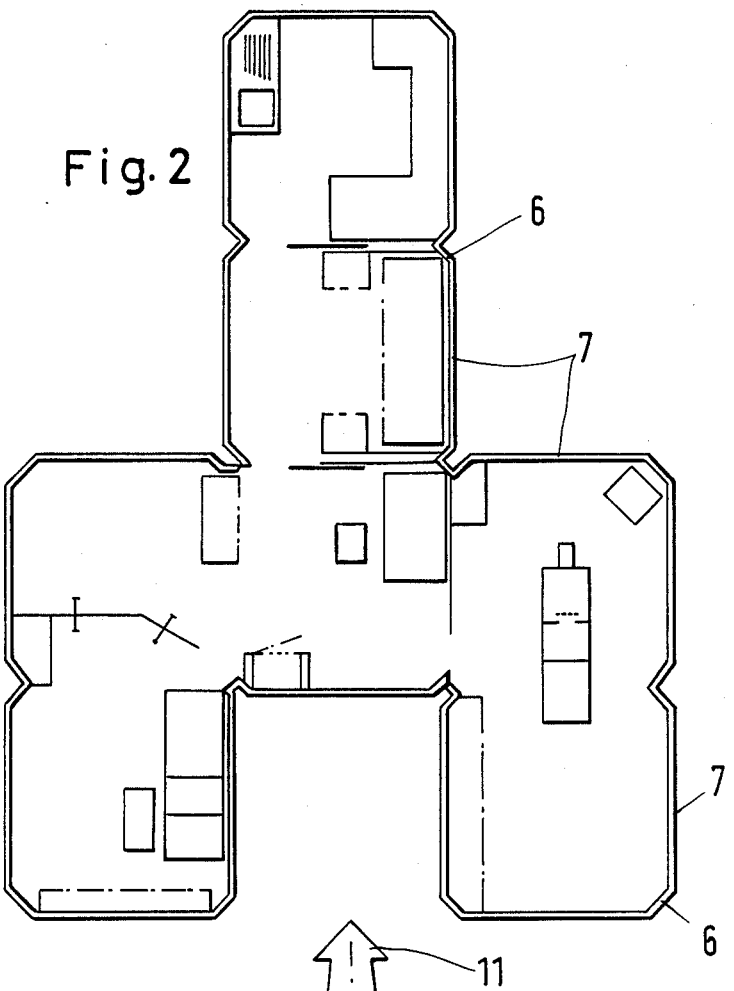

By using additional supplementary sections still to be mentioned, systems of any desired form can be provided by leaving out sandwich plates 1, for example, medical treatment units (as shown in the ground plan in FIG. 2). In this way, an entrance hall and office Y, an examination and treatment room X, an emergency operations room and examination and treatment room Z, an X-ray room R and a laboratory room L, each consisting of a cube, are combined into one unit.

Figure 3:
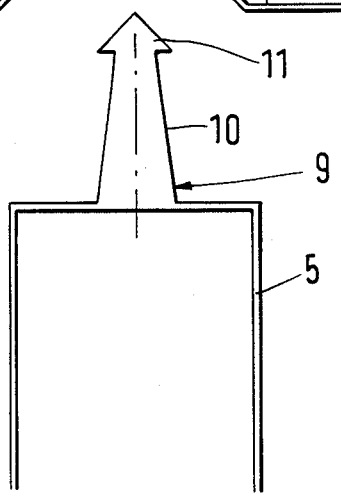
FIG. 3—a sectional view of the edge section, with which the sandwich are connected on the side of the wall.

In order easily to assemble the cube itself, the edges of the sandwich plates 1 are provided as shown in FIG. 3 with undetachable and fixed edge sections 5. Such edge sections 5 consist of a part having U-shaped cross-section which is connected, detachable, air- and water-tight, with all the edges of the sandwich plate 1, and which surrounds the sandwich plate 1 with its U-shaped part. It can be glued, welded, cold-welded, bolted or riveted, and the individual methods of connection can be combined with one another. The edge section 5 carries an arrow-shaped spigot 9 on its face which has a shaft 10 tapering towards its head and a triangular head 11 broadened at its base as compared with the shaft. All the sections so far mentioned can be formed as extruded sections from light metal or aluminum but also, should the shape permit, from glass fibre plastic.

Figure 4:
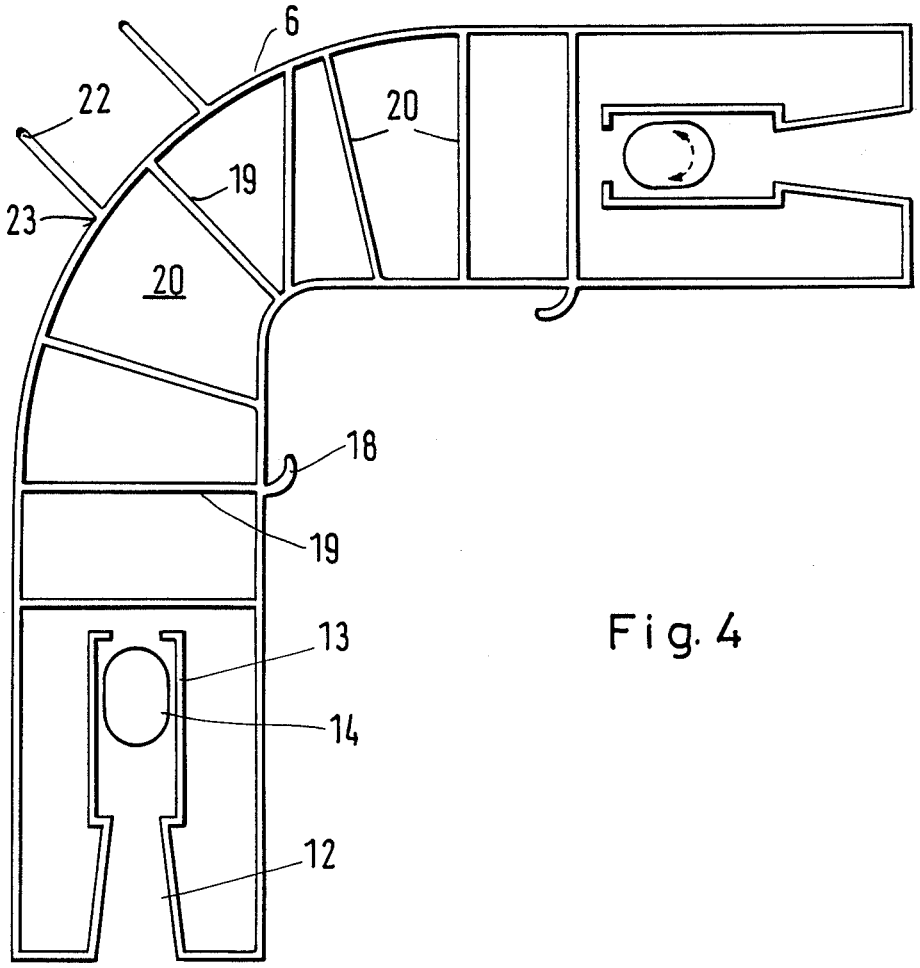
FIG. 4—a sectional view of an angle section.
Figure 9:
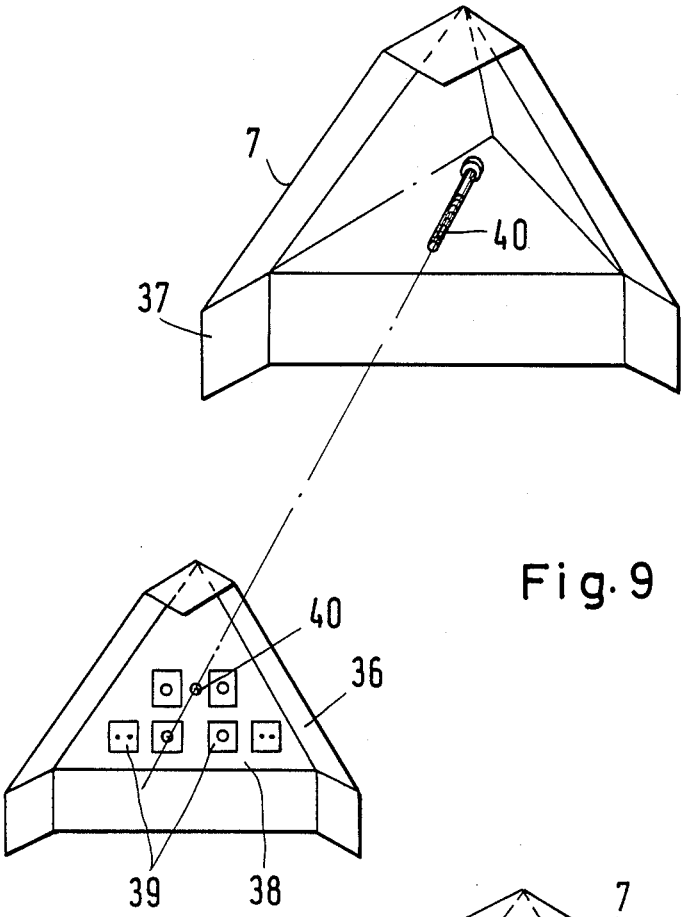
FIG. 9—corner covers shown separately.

FIG. 4 shows a corner section giving the curved form in continuous lines and by way of indication the straight oblique form in dotted lines. The corner section 6 has two sockets 12 running at right angles to one another and bounded by web sections 13 which are spring towards the end and deflectable outwards, the configuration and shape of which match the arrow-shaped spigot 9 on the edge section 5 precisely in shape and dimensions. Towards the end of these web sections is a spreader spindle 14 lying in the longitudinal direction of the corner section 6 and non-circular in cross-section and pivoted at the upper and lower end. At least one of its ends has an actuating square or hexagonal head 16 accessible through the wall via a slot 15. A guide block 17 is inserted in each case to support the pivoted ends of the spreader spindle 14 in the end of the corner section 6. By turning the actuating square or hexagonal head 16, the web sections 13 can, as illustrated on the right in FIG. 5, be spread so far apart widthwise from one another that the arrow-shaped spigot 9 can be inserted in the socket 12. After the spreader spindle 14 is turned back, a situation according to FIG. 5, left, is reached, i.e. the arrow-shaped spigot 9 is held form- and force-locking in the corner section 6. For purposes of assembly, it can be removed again by spreading the web sections or turning the spreader spindle 14.

Figure 10:
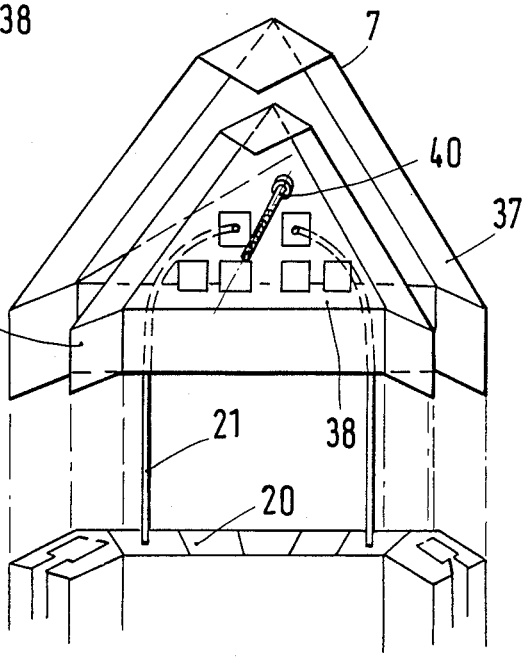
FIG. 10—corner covers shown together with indicated connection between panel and supply lines in a corner section with oblique middle piece.

In the diagram of FIG. 4, the area between the open ends 12 of the corner section 6 is curved in shape, the inside radius of curvature being very small in comparison to outside radius of curvature. Cover plates, hooks 18 and the like can be used to secure objects of indoor equipment. The small internal radius makes possible full use of the cube 8. The dotted lines show the outline indicating an alternative form of the corner section 6, in which section walls are provided at an angle 45° instead of the curves. In both forms of embodiment, this area is subdivided by a number of webs 19 into chamber 20 which contain, as shown in FIG. 10, for example, supply and discharge pipes and tubes 21 within foam.

The outside curve or outside surface of the corner section is provided with two supporting side-pieces 22 running apart from one another and parallel to the mean radius or to the middle of the angle and which have holes prepared at suitable intervals or at least above and below. In accordance with FIG. 7, for example, lifting hooks 24 can be bolted to these supporting side-pieces to permit transport by helicopter, while uprights 25 can be installed at the lower end to level up the floor of the cube 8 using telescopic adjustment.

In order to arrive at systems as in FIG. 2, sandwich plates 1 which are not needed when cubes 8 are placed side-by-side, are left out and the vertical corner sections 6 connected with the open inside ends by a clamp section 26 (FIGS. 11 and 12). The clamp section 26 is essentially U-shaped in cross-section, so that the legs 27 of its U lie against the outside walls of the corner sections 6. It has two separate parallel arrow-shaped spigots 9 which correspond exactly to the shape of the edge sections 5. Like the latter, the spigots 9 are inserted into the recesses 12, so that the two corner sections 6 are closely interconnected into one firm unit. In the area of the floor and of the roof, but at least in the floor area, such an approach to the connection of neighboring cubes 8 is unsuitable, because the ends of the corner sections 6 sticking upwards would be like steps or obstacles. To this end, adjustment sections 28 are therefore provided, whereby the embodiment in accordance with FIG. 13 has flanking areas 29 corresponding to the ends of the corner sections 6 and has a middle part 30 consisting of several chambers 32 separated by webs 31. Such chambers can be lined with foam for heat insulation purposes. The embodiment in accordance with FIG. 13 is mainly suited for roof areas. An alternative embodiment is shown by the adjustment section 28 in FIG. 14, consisting of three part sections. Two edge cross-sections 33 identical with one another are shaped identically to the ends of the corner sections, so that the apertures in each case are opposite one another and align with one another. In this way, a middle piece 34, equipped with arrow-shaped spigots 9, can be interposed as the third part of a section. In the floor area, for example, by means of in-built or installed support devices 35, the middle piece 34 facilitates distribution of the weight-load on the floor.

As already mentioned, the corner covers 7 are in two parts and consist of an inner cover 36 and an outer cover 37. The inner cover 36 supports a panel 38 which is equipped with numerous connector devices 39 which are not interchangeable with one another and which are connected to the supply and discharge pipes and tubes 21 in the corner section 6. The outer cover 37 is superimposed, by means of elastic sealing which is not shown, on the outside of corner sections which abut one another. It supports a locking bolt 40 which is, for example, threaded and passes through a hole 41 in the panel 38, so that the two covers 36, 37, by means of a bolt lever or a nut, can be drawn firmly together and fit not only closely but firmly.

Linking the connection devices 39 with the supply and discharge pipes and tubes 21 can be effected by quick connectors which are not shown, so that assembly can proceed in a matter of minutes. Suitable material for the corner covers is plastic, light metal or the like.

All the individual features and combinations of features appearing in the description and/or the drawings are regarded as essential to the invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A mobile container system for providing rooms for human occupancy, comprising:

a plurality of wall elements each having spaced edges; and means for connecting said wall elements together and including a first plurality of angle elements each having spaced edges, a second plurality of edge connector elements each having an edge fittable onto one of said edges of said wall elements, a plurality of edge portions having at least one arrow-shaped formation in each of said elements of one of said first and second pluralities, a plurality of edge portions having at least one spreadable socket-shaped formation in each of said elements of the other one of said first and second pluralities, said spreadable socket-shaped formations engagable with said arrow-shaped formation, and a plurality of spreaders rotatably movable between a first position, in which they spread said socket-shaped formations so as to allow insertion of said arrow-shaped formations into said socket-shaped formations, and a second position, in which said spreaders release said socket-shaped formations so that said socket-shaped formations engage said arrow-shaped formations and thereby connect said wall elements together when said edge connector elements are fitted to said edges of said wall elements, each one of said spreaders being accessible to be rotatably movable from outside said connecting means.

2. The mobile container system as defined in claim 1, wherein said wall elements are formed as flat square sandwich shaped plates, said plurality of edge portions with arrow-shaped formations having a triangular arrow head cross-section and an arrow shaft cross-section tapering toward said arrow head cross-section, said edge connector elements also having U-shaped cross-sectional portions being tightly fittable onto said edges of said wall elements.

3. The mobile container system as defined in claim 1, wherein each of said wall elements has a central core, said central core having two sides and being composed of polyurethane rigid foam, and a layer coating each of said sides of said core, said layer being composed of material selected from a group consisting of aluminum and glass fiber, said edge connector element being composed of extruded material selected from a group consisting of aluminum and glass fiber.

4. The mobile container system as defined in claim 1, wherein at least one of said wall elements is formed with a ventilation opening.

5. The mobile container system as defined in claim 1, wherein at least one of said wall elements is formed with a window opening.

6. The mobile container system as defined in claim 1, wherein at least one of said wall elements is formed with a door opening.

7. The mobile container system as defined in claim 1, wherein at least one of said angle elements is formed with multi-chambered hollow portions.

8. The mobile container system as defined in claim 1, wherein each of said wall elements has four edges, each of said edge connectors being tightly fittable to each of said edges of said wall elements.

9. The mobile container system as defined in claim 1, wherein two of said edges of said angle elements contain said socket-shaped formations and the latter are arranged perpendicular to each other.

10. The mobile container system as defined in claim 1, wherein each of said wall elements has four edges, at least six of said wall elements being arranged and connected together by said connection means to form at least one cube-shaped structure.

11. The mobile container system as defined in claim 10, wherein each of said angle elements has an inside surface and an outside surface, said cube-shaped structure having corner areas, said angle elements being formed so as to define an open space at each of said corner areas: further comprising:

inner and outer angle covers for closing off said open space at each of said corner areas of said cube-shaped structure, said outer angle cover being formed to accommodate said angle elements from outside, said inner cover being formed to accommodate said angle elements from inside;

supply and discharge lines arranged within and extending from said angle elements;

means for bolting said inner and outer covers together; and a connecting panel having a hole for receiving said bolting means, said panel being connectable to said outer cover and having non-interchangeable socket-and-connector receiving means for connecting with said supply and discharge lines.

12. The mobile container system as defined in claim 1, further comprising:

means for supporting the mobile container system and including each of said angle elements having a longitudinal central angular portion and an outer surface and two side plates running symmetrically along said central angular portion longitudinally on said outer surface, said side plates being spaced apart from each other and being formed to support the mobile container system.

13. The mobile container system as defined in claim 12; further comprising:

means for supporting said mobile container system including at least one vertically adjustable upright connectable to said side plates.

14. The mobile container system as defined in claim 12; further comprising:

means for transporting said mobile container system, said transporting means being connectable to said side plates.

15. The mobile container system as defined in claim 1, wherein said wall elements are arranged and connected together to form a plurality of cube-shaped units;

said connecting means further including a plurality of clamping elements each having edges provided with two of said arrow-shaped formations simultaneously engageable with said socket-shaped formations of said edge portions so as to connect said cube-shaped units together, and a plurality of adjustment elements having edges provided with formations which correspond to said formations of said angle elements.

16. The mobile container system as defined in claim 15, wherein each of said adjustment elements has end portions and a middle portion between said end portions, each of said end portions having said socket-shaped formations engageable with said arrow-shaped formations, said middle portion being formed with a plurality of chambers subdividing said middle portion.

17. The mobile container system as defined in claim 1, wherein each of said angle elements forms a plurality of chambers and has two ends and a central portion between said ends, said central portion having at least one wall forming a boundary between said chambers; further comprising:

a foam contained within said chambers; and supply and discharge lines contained within said foam and said chambers.

18. The mobile container system as defined in claim 17, wherein said central portion has an outer radius of curvature and an inner radius of curvature which is smaller than said outer radius of curvature.

19. The mobile container system as defined in claim 17, wherein said central portion extends straight at an angle of 45° to said ends.

20. The mobile container system as defined in claim 1, wherein each respective one of said arrow-shaped formations and each respective one of said socket-shaped formations are formed so as to be form-locked when a respective one of said spreaders is in said second position.

21. The mobile container system as defined in claim 1, wherein each of said spreaders are arranged between a respective two of said socket-shaped formations.

22. A mobile container system for providing rooms for human occupancy, comprising:

a plurality of wall elements each having spaced edges; and means for connecting said wall elements together and including a first plurality of angle elements each having spaced edges, a second plurality of edge connector elements each having an edge fittable onto one of said edges of said wall elements, a plurality of edge portions having at least one arrow-shaped formation in each of said elements of one of said first and second pluralities, a plurality of edge portions having at least one spreadable socket-shaped formation in each of said elements of the other one of said first and second pluralities, said spreadable socket-shaped formations engagable with said arrow-shaped formation, and a plurality of spreaders movable between a first position, in which they spread said socket-shaped formations so as to allow insertion of said arrow-shaped formations into said socket-shaped formations, and a second position, in which said spreaders release said socket-shaped formations so that said socket-shaped formations engage said arrow-shaped formations and thereby connect said wall elements together when said edge connector elements are fitted to said edges of said wall elements, each of said socket-shaped formations of said edge portions have walls and a length, each of said spreaders being formed as a non-circular shaped spindle with upper and lower ends, said upper and lower ends being pivotably connected to one of said angle elements and being located between said walls, each of said spreaders being movable to said first position to spread said walls apart from each other when said spreader is pivoted traversely relative to said length.

23. The mobile container system as defined in claim 22, wherein each of said spreaders has an oval cross-section.

24. The mobile container system as defined in claim 22; further comprising:

an actuating nut head connectable to one of said ends of one of said spreaders so that said one spreader turns in response to a turning of said actuating nut head.

25. The mobile container system as defined in claim 24, wherein said nut head has a hexagonal shape.

26. A mobile container system for providing rooms for human occupancy comprising:

a plurality of wall elements each having spaced edges;

means for connecting said wall elements together and including a first plurality of angle elements each having spaced edges, a second plurality of edge connector elements each having an edge fittable onto one of said edges of said wall elements, a plurality of edge portions having at leasat one arrow-shaped formation in each of said elements of one of said first and second pluralities, a plurality of edge portions having at least one spreadable socket-shaped formation in each of said elements of the other one of said first and second pluralities, said spreadable socket-shaped formations engagable with said arrow-shaped formation, a plurality of spreaders movable between a first position, in which they spread said socket-shaped formations so as to allow insertion of said arrow-shaped formations into said socket-shaped formations, and a second position, in which said spreaders release said socket-shaped formations so that said socket-shaped formations engage said arrow-shaped formations and thereby connect said wall elements together when said edge connector elements are fitted to said edges of said wall elements, said wall elements being arranged and connected together to form a plurality of cube-shaped units, said connecting means further including a plurality of clamping elements each having edges provided with two of said arrow-shaped formations simultaneously engagable with said socket-shaped formations of said edge portions so as to connect said cube-shaped units together, and a plurality of adjustment elements having edges provided with formations which correspond to said formations of said angle elements; and a vertically adjustable upright for supporting said mobile container system, said adjustment element being formed with two end pieces and a middle piece between said end pieces so as to form three part-sections, said end pieces being independent from each other and each having two opposite edges with said socket-shaped formations, said socket-shaped formations being engagable with said arrow-shaped formations, said middle piece having two arrow-shaped formations arranged in opposite directions from each other and a hollow center area arranged for receiving said vertically adjustable upright.

* * * * *